US007766313B2

(12) United States Patent
Panosian

(10) Patent No.: US 7,766,313 B2
(45) Date of Patent: Aug. 3, 2010

(54) SPRING CLAMP SYSTEM

(75) Inventor: Michael Panosian, Glendale, CA (US)

(73) Assignee: Amarillo Hardware Company, Amarillo, TX (US)

( * ) Notice: Subject to any disclaimer, the term of this patent is extended or adjusted under 35 U.S.C. 154(b) by 1458 days.

(21) Appl. No.: 10/706,491

(22) Filed: Nov. 12, 2003

(65) Prior Publication Data

US 2005/0098932 A1 May 12, 2005

(51) Int. Cl.
*B25B 1/20* (2006.01)

(52) U.S. Cl. ..... 269/37; 269/3; 269/6; 269/95

(58) Field of Classification Search ..... 269/3, 269/6, 237–239, 95, 75, 152
See application file for complete search history.

(56) References Cited

U.S. PATENT DOCUMENTS

| | | | | |
|---|---|---|---|---|
| 2,667,678 | A | 2/1954 | Hargrave et al. | |
| 3,456,262 | A | 7/1969 | Coon | |
| 3,779,108 | A | 12/1973 | Reiter | |
| 4,253,649 | A * | 3/1981 | Hewson | 269/45 |
| 4,813,107 | A | 3/1989 | Cetrone | |
| 4,943,039 | A * | 7/1990 | Jackson | 269/45 |
| 4,967,693 | A * | 11/1990 | Prue | 119/712 |
| D317,116 | S | 5/1991 | Nimtz et al. | |
| D322,390 | S | 12/1991 | Nimtz et al. | |
| 5,312,094 | A * | 5/1994 | Zera | 269/3 |
| D350,892 | S | 9/1994 | Sorensen | |
| 5,547,305 | A * | 8/1996 | Treche | 403/97 |
| 5,765,820 | A | 6/1998 | Marusiak | |
| 5,785,305 | A * | 7/1998 | Stalker | 269/37 |
| D420,896 | S | 2/2000 | Blackburn et al. | |
| D428,568 | S * | 7/2000 | Leon, Jr. | D8/71 |
| D442,047 | S | 5/2001 | Hicks | |
| 6,357,710 | B1 * | 3/2002 | Fielden et al. | 248/276.1 |
| D457,409 | S | 5/2002 | Noniewicz | |
| 6,520,495 | B1 * | 2/2003 | La Mendola | 269/45 |
| 6,983,930 | B1 * | 1/2006 | La Mendola et al. | 269/45 |
| 2005/0098932 | A1 * | 5/2005 | Panosian | 269/37 |

* cited by examiner

*Primary Examiner*—Lee D Wilson
(74) *Attorney, Agent, or Firm*—Patterson & Sheridan, L.L.P.

(57) ABSTRACT

A spring clamping system includes improved spring clamping mechanisms and a gimbal mechanism. Removable attachment clips securely join each clamping mechanism to the gimbal mechanism while allowing positive-lock positioning and rapid repositioning of a workpiece through at least two planes of motion. Curved strengthening and alignment sections resist lateral misalignment during operation while maintaining handle alignment and clamp opening scope.

3 Claims, 16 Drawing Sheets

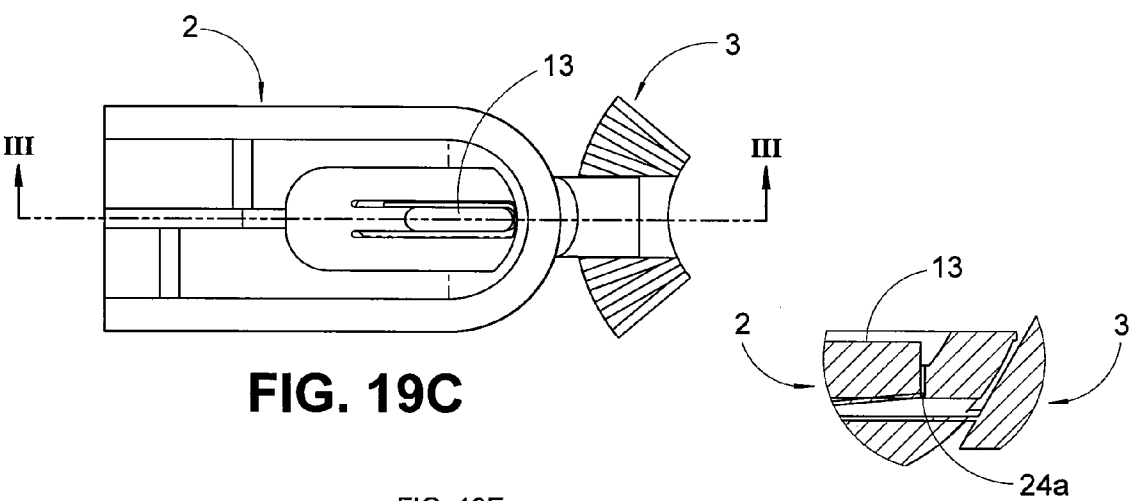
FIG. 19C
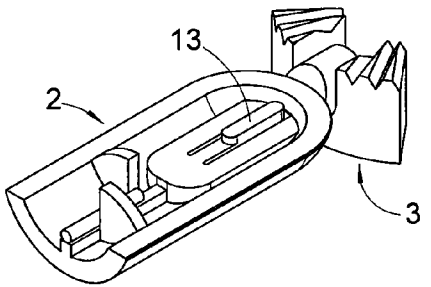
FIG. 19B
FIG. 19E
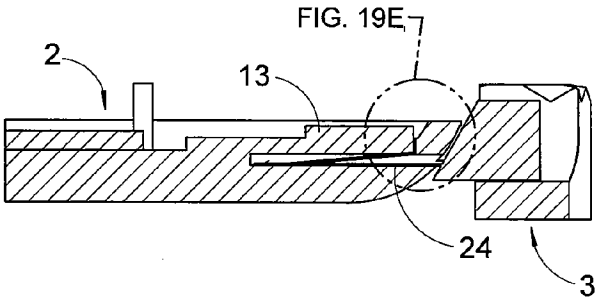
FIG. 19D
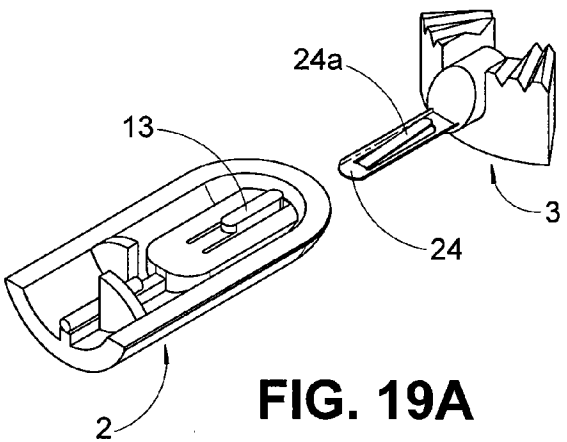
FIG. 19A

SPRING CLAMP SYSTEM

BACKGROUND OF THE INVENTION

1. Field of the Invention

The present invention relates to a spring clamp system. More specifically, the present invention relates to a spring clamp system which provides for rapidly interchangeable clamps and adjustable interlock positioning.

2. Description of the Related Art

Spring clamps are conventionally used for applying clamping forces to workpieces in opposing directions. Spring clamps include a pair of lever arms each with handles and opposing gripping jaws adapted to open and close on a work piece interposed there between. Light-duty spring clamps, sometimes called "squeeze clamps," can be quickly and conveniently applied to workpieces because they require no adjustment and are relatively inexpensive.

The gripping jaws of conventional spring clamps have a pair of work engaging surfaces. In some types of conventional spring clamps these work engaging surfaces are capable of universal alignment with a workpiece. The work engaging surfaces are most frequently affixed to the gripping jaws in a manner allowing motion about one coordinate plane. Consequently, in operation the work engaging surfaces of conventional spring clamps can close upon workpieces in a variety of non-parallel modes and hold and retain workpieces having unusual configurations.

Respective lever arms are joined at a central point where a torsional spring member provides an urging closing force between the opposing gripping jaws thereby enabling constant pressuring during a clamping operation, such as, for example, gluing, nailing, or the like. Examples of this type of conventional spring clamp can be found in U.S. Registration Nos. 5,765,820 and D350,891.

Conventional spring clamps provide a limited range of uses relative to a work piece. During use, opposing gripping jaws are placed in an opened position in which the are spaced apart and positioned over a workpiece to-be-clamped. After positioning, the levers are released and the torsion spring member urges the gripping jaws into a closed position in which the opposing gripping jaws are spaced together with the workpiece secured there between.

Alternative conventional spring clamps include a non-removable pin fixably extending from one of the opposing handles opposite the gripping jaw. The fixed pin joins the conventional spring clamp to a friction-connective member having a fixing clasp. During use, this type of conventional spring clamp is, for example, attached to a desk edge and a piece of note paper is fixed in the fixing clasp. In this manner, a conventional spring clamp can be used as a light-weight note holder. An example of this type of conventional spring clamp can be found in U.S. Registration No. D420,896.

During use, the physiological action of closing a human hand around the lever arms of a conventional spring clamp results in opposing lateral vectors applied to each handle relative to a clamping plane. During opening, these opposing lateral vectors combine and create a lateral torsion relative to a clamping plane causing undesirable handle-to-handle misalignment and transverse handle bending at high clamping pressures.

The handles on each lever arm are conventionally constructed from a semi-rigid material, such as metal or plastic, and rolled or formed into a broad U-shape to resist lateral torsional bending during use. Where demand for increased closing force exists, conventional spring clamps increase the weight of the torsional spring member, resulting in a corresponding increase in opening pressure expressed on the handles of the lever arms perpendicular to the clamping plane. This results in an increased risk of bending and misaligning the handles despite the U-shape.

Conventional cures to this increased bending risk include thickening the semi-rigid handle material, resulting in increased cost, and extending the walls of the U-shaped handles resulting in thicker handles, difficulty for small-handed users, and a corresponding reduction in clamping capacity. Where these conventional cures are insufficient, the handles are misaligned, cannot close properly, and break easily.

OBJECTS AND SUMMARY OF THE INVENTION

An object of the present invention is to provide a spring clamping system which overcomes the problems noted above.

Another object of the present invention is to provide a spring clamping system which allows slimmer but stronger and more rigid handle portions while maintaining, even increasing, a grip capacity.

It is another object of the present invention to provide a spring clamping system having automatic realignment for handle portions upon a closing motion whereby the system resists external lateral or rotational torsion despite increased clamping pressure.

It is another object of the present invention to provide a spring clamping system having clamping mechanisms in clip-lock-releasable connections with a gimbal mechanism.

It is another object of the present invention to provide a spring clamping system where attachment clips do not extend from clamp handle portions.

It is another object of the present invention to provide a spring clamping system where attachment clips rotate in 360° relative to a lockable gimbal allowing a clamping mechanism to rotate in relative to the gimbal.

It is another object of the present invention to provide a lockable and easily readjusted gimbal mechanism which allows the entire clamping mechanism to align in at least two planes of motion, and in an alternative embodiment, three planes of motion.

The present invention relates to a spring clamping system including an improved spring clamping mechanisms and a joining gimbal mechanism. Attachment clips securely join each clamping mechanism to the gimbal mechanism allowing positive-lock positioning and rapid repositioning of a workpiece through at least two planes of motion. Curved strengthening and alignment sections resist handle misalignment while maintaining a clamp opening scope.

According to an embodiment of the present invention there is provided a spring clamping system comprising: at least one means for clamping an external workpiece, the clamping means having two lever arms joining each other at at least one hinge point on a plane of symmetry defined between the lever arms, each the hinge point between a jaw portion and a handle portion on the lever arms, at least one gimbal mechanism including at least one radially projecting rotation spindle, means for releasably attaching at least one of the handle portions to the rotation spindle during a use of the spring clamp system, and means for interlock repositioning the one handle portion through at least two planes of motion during the use, thereby providing an easily repositioned spring clamp system.

According to an embodiment of the present invention there is provided a spring clamping system, further comprising:

means for aligning and strengthening each the handle portion during an opening of the jaw portions, the means for aligning and strengthening including a plurality of curved strengthening ribs arrayed alternatingly along an inner concave surface of each the handle portion, and each the rib having a convex curved surface, whereby during the opening of the jaw portions, the opposing convex curved surfaces contact the inner concave surfaces and slidably guide the handle portions into mutual alignment while resisting an external torsion applied to the handle portions during the opening.

According to an embodiment of the present invention there is provided a spring clamping system, further comprising: a pair of opposing gimbal housings in the gimbal mechanism, the gimbal housings having a common pivot axis, a bolt pivotally joining the opposing gimbal housings along the axis, means for interlock repositioning including means for camably releasing the bolt during an adjustment of the gimbal mechanism and allowing the gimbal housing to rotate about the axis, a spacer projecting perpendicular to the axis on an inside of each the gimbal housing proximate the axis, and a spindle housing projecting perpendicular to the axis on the inside of each the gimbal housing distal the axis.

According to an embodiment of the present invention there is provided a spring clamping system, further comprising: a plurality of housing teeth radially arrayed on an inside surface of each the gimbal housing, a plurality of spacer teeth radially arrayed on a top surface of each the spacer interlocking with corresponding housing teeth during the use, a plurality of spindle housing teeth radially arrayed on a top surface of each the spindle housing, and the spindle housing teeth interlocking with corresponding housing teeth during the use, whereby the means for interlock repositioning tightly interlocks each the gimbal housings after the adjustment.

According to an embodiment of the present invention there is provided a spring clamping system, further comprising: a U-shaped spindle section in each spindle housing, a spindle ring groove within each respective U-shaped spindle section, a spindle ring projecting from an outer circumference of each the rotation spindle, and each the spindle rings pivotally sliding in respective spindle ring grooves, thereby retaining each the rotation spindle in the spindle housing during an adjustment and the use.

According to an embodiment of the present invention there is provided a spring clamping system, further comprising: an elastomeric grommet bounding an outer end circumference of each the rotation spindle, a grommet groove in each U-shaped spindle section proximate the spindle ring groove, and each the grommet pivotally sliding in respective grommet grooves during the adjustment and aiding retention of the rotation spindle in the spindle housing during the use.

According to an embodiment of the present invention there is provided a spring clamping system, wherein: an outer circumference of the elastomeric grommet extending from the U-shaped spindle section into a parallel alignment with tops of the plurality of spindle housing teeth, and the plurality of housing teeth compressing the outer circumference and the rotation spindle during the use, thereby firmly fixing a rotation position of the rotation spindle relative to the gimbal mechanism.

According to an embodiment of the present invention there is provided a spring clamping system, further comprising: a plurality of strengthening ribs radially arrayed on an outside of each the gimbal housing, a locking lever in the means for camably releasing the bolt, and an inner surface of the locking lever matching an outer profile of the strengthening ribs, whereby during the use the gimbal mechanism has a compact shape.

According to an embodiment of the present invention there is provided a spring clamping system, further comprising: an attachment clip in the means for releasably attaching, the attachment clip fixably extending from an outer surface of each the rotation spindle, a spring member on each the attachment clip, an end of each the handle portion bounding a clip-opening in communication with a locking slot and a clip-lock release, and the clip-lock release positively retaining the spring member in the locking slot during an attachment, and releasing the spring member during a separation, whereby the spring member and the means for releasably attaching provides a positive snap release between the handle portion and the rotation spindle.

According to an embodiment of the present invention there is provided a spring clamping system comprising: at least one clamping mechanism adapted to clamp a workpiece, the clamping mechanism having two lever arms joining each other at at least one hinge point or a pair of coaxial hinge points on a plane of symmetry defined between the lever arms, each the hinge point between a jaw portion and a handle portion on the lever arms such that during a use the handle portions can be moved between a closed position in which the jaw portions are proximate each other and an open position in which the jaw portions are spaced apart, means for aligning and strengthening the handle portions during an opening of the jaw portions, whereby the means for aligning guides the handle portions into a sliding mutual realignment and resists an external torsion applied to the handle portions during the opening, and gimbal means for lockably positioning one of the handle portions through at least two planes of motion relative to the gimbal means.

According to an embodiment of the present invention there is provided a spring clamping system: wherein: the means for aligning and strengthening includes a plurality of curved strengthening ribs arrayed alternatingly along an inner concave surface of each the handle portion, and each the rib having a convex curved surface such that during the opening of the jaw portions, the opposing convex curved surfaces contact the inner concave surfaces and slidably guide the handle portions into alignment.

According to an embodiment of the present invention there is provided a spring clamping system, further comprising: at least one rotation spindle projecting radially from the gimbal means, the gimbal means including means for releasably attaching the one of the handle portions to the rotation spindle during the use, and spring means interposed between the arm members providing an urging closing force to the jaw portions during the use.

According to an embodiment of the present invention there is provided a spring clamping system, wherein: the aligning and strengthening means includes means for retaining legs of the spring means in respective handle portions, and the means for retaining includes inner surfaces on each the strengthening rib extending from the inner concave surface of each the handle portion to the convex curved surface, thereby trapping the legs of the spring means between the inner surfaces and the inner concave surface and minimizing damage to the handle portions.

According to an embodiment of the present invention there is provided a spring clamping system, further comprising: at least one of a swivel gripping tip and a needle-nosed gripping tip operably joined to a gripping end of each the jaw portion and adapted to grip the workpiece.

According to an embodiment of the present invention there is provided a spring clamping system, further comprising: an attachment clip in the means for releasably attaching, the attachment clip fixably extending from an outer surface of each the rotation spindle, a spring member on each the attachment clip, an end of each the handle portion bounding a clip-opening in communication with a locking slot and a clip-lock release, and the clip-lock release positively retaining the spring member in the locking slot during an attachment, and releasing the spring member during a separation, whereby the spring member and the clip-lock release provide a positive snap release between the handle portion and the rotation spindle.

According to another embodiment of the present invention, there is provided a clamping mechanism, comprising: two arm members defining a plane of substantial symmetry, the arm members pivotally joining each other at a pair of hinge points on the plane of symmetry, the hinge points between respective jaw portions and handle portions such that during a use the handle portions can be moved between a closed position in which the jaw portions are proximate each other and an open position in which the jaw portions are spaced apart, spring means interposed between the arm members providing an urging closing force to the jaw portions, means for retaining legs of the spring means in respective handle portions during the use, and means for aligning and strengthening the handle portions during an opening of the jaw portions, whereby the means for aligning guides the handle portions into a sliding mutual realignment and resists an external torsion applied to the handle portions during the opening.

According to an embodiment of the present invention there is provided a spring clamping mechanism, wherein: the means for aligning and strengthening includes a plurality of curved strengthening ribs arrayed alternatingly along an inner concave surface of each the handle portion, and each the rib having a convex curved surface such that during the opening of the jaw portions, the opposing convex curved surfaces contact the inner concave surfaces and slidably guide the handle portions into alignment.

According to an embodiment of the present invention there is provided a spring clamping mechanism, wherein: the means for retaining includes inner surfaces on each the strengthening rib extending from the inner concave surface of each the handle portion to the convex curved surface, thereby trapping the legs of the spring means between the inner surfaces and the inner concave surface and minimizing damage to the handle portions.

According to an embodiment of the present invention there is provided a spring clamping system, comprising: a first means for clamping a first workpiece, a second means for clamping a second workpiece, gimbal means for lockably positioning the first means for clamping relative to the second means for clamping in a positive-lock position relative to two planes of movement, and the means lockably positioning including a plurality of toothed interlocks, whereby the means for lockably positioning prevents relative movement between first and second means for clamping.

The above, and other objects, features and advantages of the present invention will become apparent from the following description read in conduction with the accompanying drawings, in which like reference numerals designate the same elements.

BRIEF DESCRIPTION OF THE DRAWINGS

FIGS. 19A-19E are views illustrating the connection of the clamping mechanism and the gimbal mechanism.

DETAILED DESCRIPTION OF THE PREFERRED EMBODIMENTS

Figure 1:
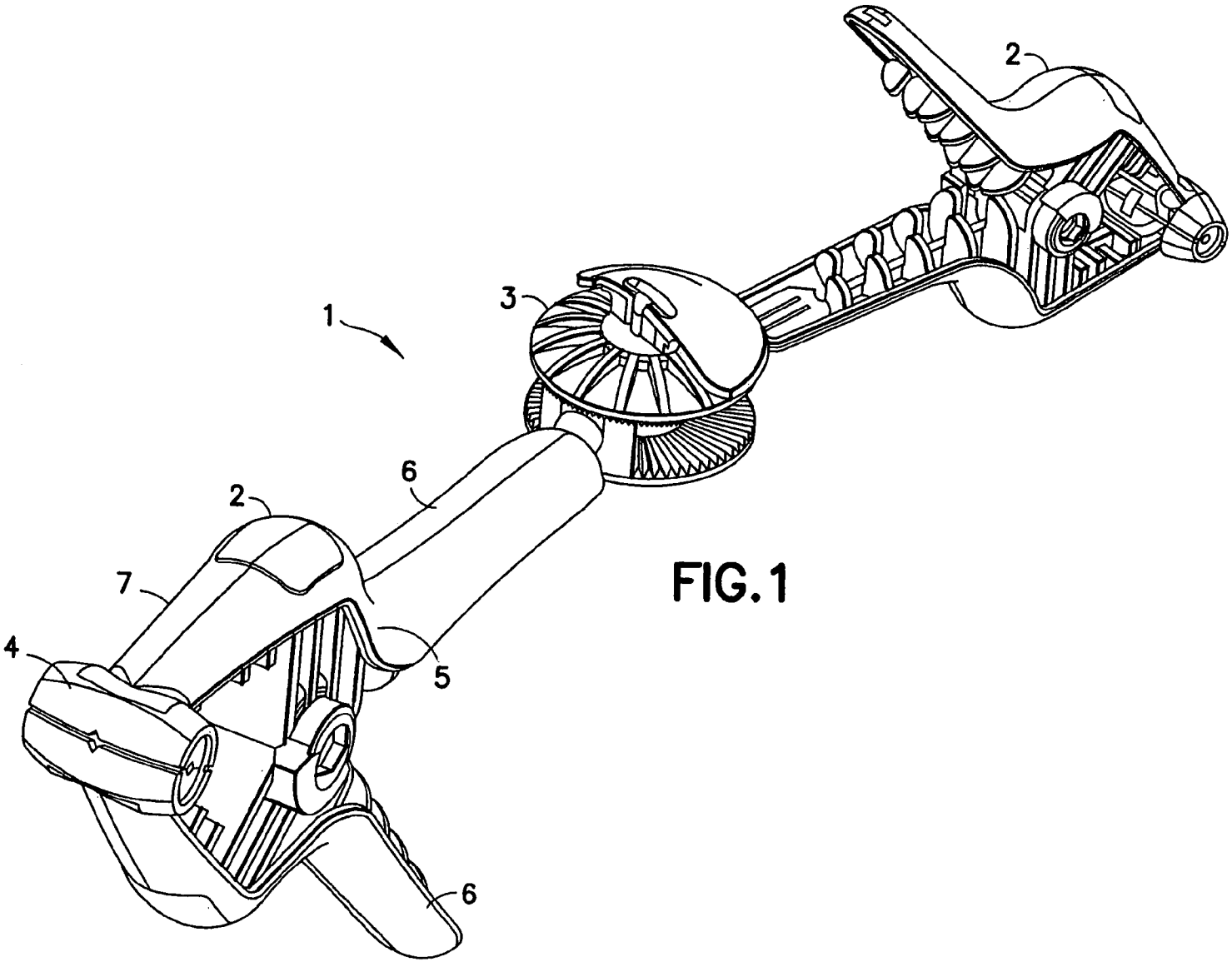
FIG. 1 is a perspective view of a spring clamping system, according to one embodiment of the present invention.
Figure 2:
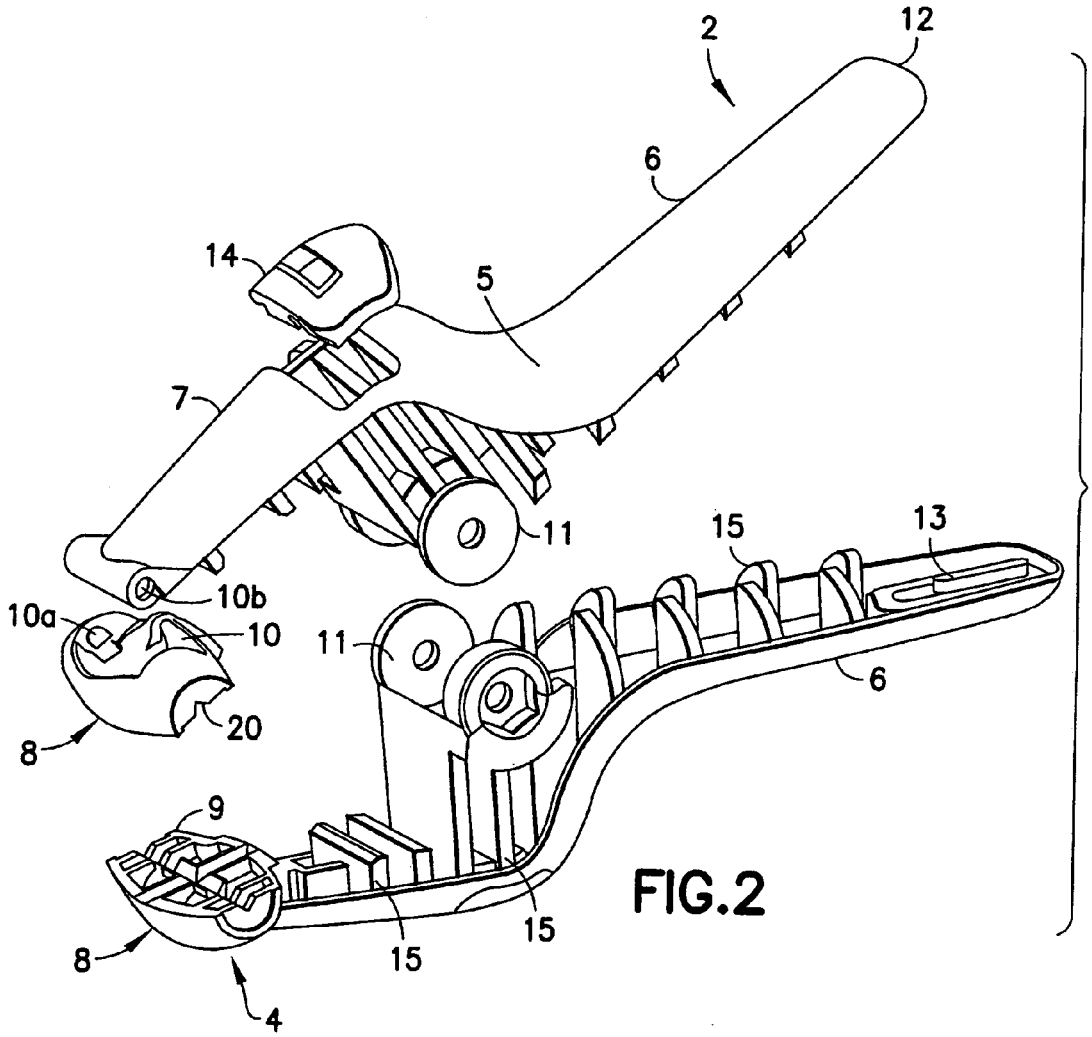
FIG. 2 is an exploded view of a clamping mechanism.

Referring now to FIGS. 1 and 2, a spring clamping system 1 includes at least one clamping mechanism 2 and a gimbal mechanism 3. Clamping mechanism 2 includes two opposing lever arms 5 each having opposing handle portions 6 and opposing jaw portions 7. In the present embodiment, jaw portions 7 each include swivel tip mechanism 4. Lever arms 6 are elongate members centrally and rotationally joined at a pair of coaxial hinge points formed by hinge members 11,11 and a cross bolt (not shown). Gimbal mechanism 3 allows independent positioning of each clamping mechanism 2 through three planes of movement.

Lever arms 5 are formed by conventional plastic forming methods and may be any material or composition sufficiently rigid to operate as desired. As an example, lever arms 5 may be formed from a plastic, a plastic and a filler, or other artificial composition susceptible to conventional plastic forming methods. A display member 14 on a top surface of each lever arm 5 snaps into a corresponding recess (shown but not numbered) and simplifies manufacture while allowing customization according to customer demand.

A plurality of strengthening sections 15 extend along the inner length of lever arms 5. Along opposing jaw portions 7, strengthening sections 15 act as gripping teeth and allow clamping mechanism 2 to clamp round and ovoid objects with increased stiffness. Along handle portions 6, an alternating array of strengthening sections 15 allows reduced handle thickness and improved handle stiffness while minimizing lateral and torsional misalignment forces and correcting any resulting misalignment during clamping operations, as will be explained.

A clip opening 12 at a distal end of each handle portion 6 is in connective communication with a positive-lock-type clip-lock release 13. During operation, an attachment clip (shown later) joins gimbal mechanism 3 with clamping mechanism 2 by inserting through click opening 12 and linking with clip-lock release 13.

Swivel tip mechanism 4, on each lever arm 5, includes a swivel tip 8 rotationally joined to a jaw end of respective jaw portions 7. Each swivel tip 8 includes a gripping face 9 opposite an opposing joining face 10. A set of joining pins 10*a*, extend inward opposite a center on joining face 10. Swivel tips 8, 8 may be formed from any suitable material capable of gripping a workpiece, and include, for example, an elastomeric compound.

During an assembly of clamping mechanism 2, joining pins 10*a* removably snap-lock into a corresponding set of coaxial joining holes 10*b* extending from jaw portion 7 opposite joining face 10. Joining pins 10*a* swivel within joining holes 10*b*, and during use allow swivel tip 8 to pivot relative to an external workpiece and secure a good grip. A set of grooves 20 extend laterally and longitudinally along each gripping face 9 and allow clamping mechanism 2 to easily secure rounded or angular objects.

Figure 3:
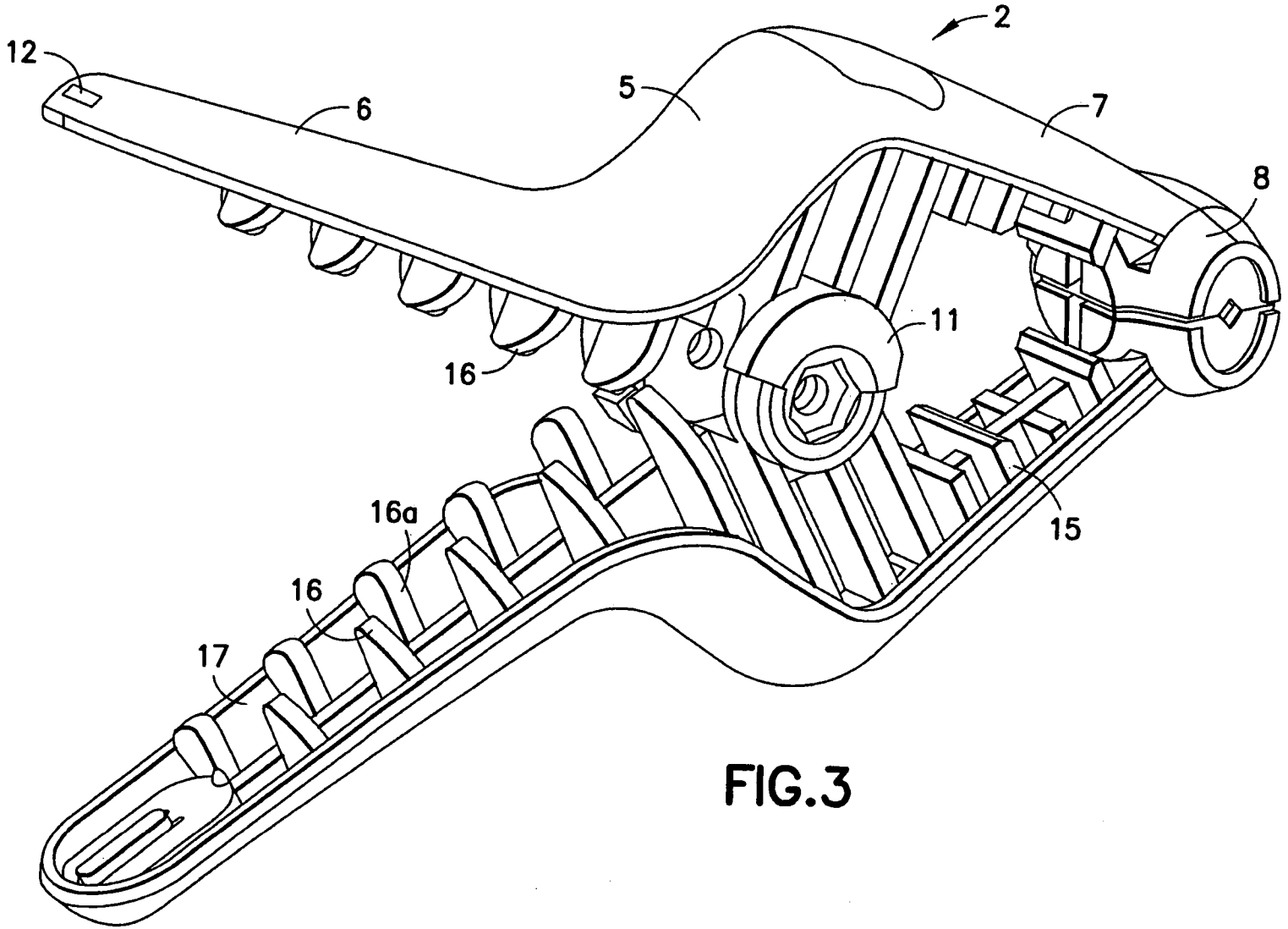
FIG. 3 is a perspective view of the clamping mechanism.

Referring now to FIG. 3, strengthening sections 15 extend in an alternating array along a concave inner mating surface 17 on respective handle portions 6. Inner mating surface 17 is opposite an outer gripping surface (shown but not numbered) on each handle portion 6. The outer gripping surface of handle portions 6 may be smooth or rough as desired by a designer. A mating surface (shown but not numbered) extends along an edge of handle portions 6 and divides inner mating surface 17 from the outer gripping surface. Adjacent hinge members 11, 11, strengthening sections 15 rigidly join lever arms to an operable pivot point and allow strong opening and closing forces to occure without buckling.

Strengthening sections 15 extend from both a bottom and a side of inner mating surfaces 17 and provide substantial rigidity to handle portions 6. Each strengthening section 15 along handle portions 6 has a convex curved portion 16 shaped to match concave inner mating surface 17. An inner portion 16*a* joins curved portion 16 to a middle of mating surface 17, as will be described.

Strengthening sections 15 extend generally along the length of handle portions 6 from hinge members 11 to clip-lock release 13. In the full opened position, the mating surfaces of respective handle portions 6 contact each other and convex curved portions 16, of strengthening sections 15, contact respective concave mating surfaces 17. In this manner, much of the structure necessary to provide rigidity to each handle portion 6 is retained within the opposite handle portion 6, while simultaneously providing additional support to the respective opposing handle portion 6, and allowing each handle portion 6 to retain a thin profile with increased rigidity. Consequently handle portions 6 of the present invention provide increased strength and rigidity in the same overall size and prevent crushing damage due to over pressure in an opening operation.

Figure 4:
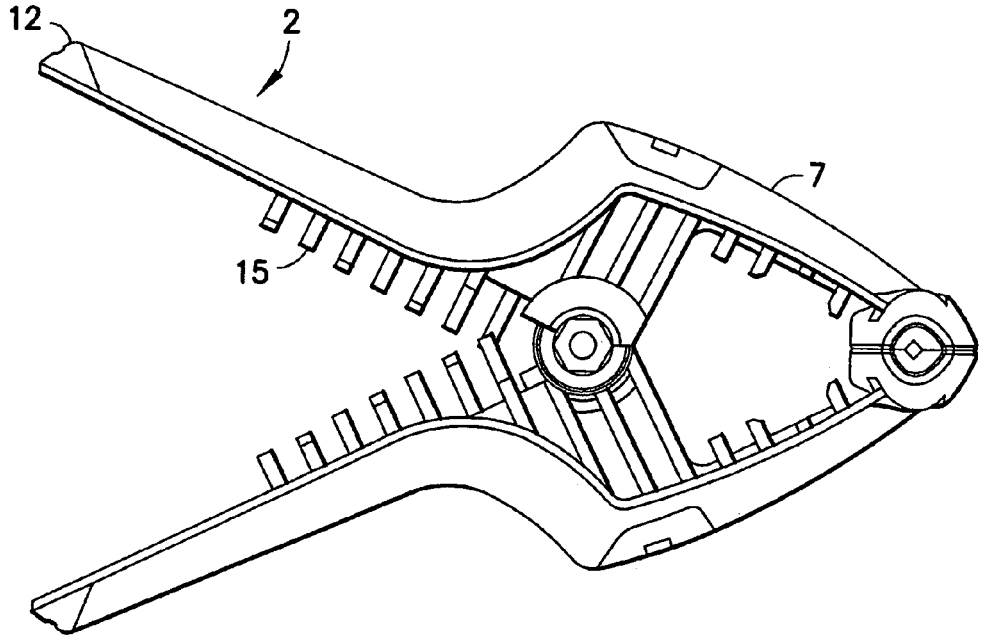
FIG. 4 is a side view of the clamping mechanism in a closed position.
Figure 5:
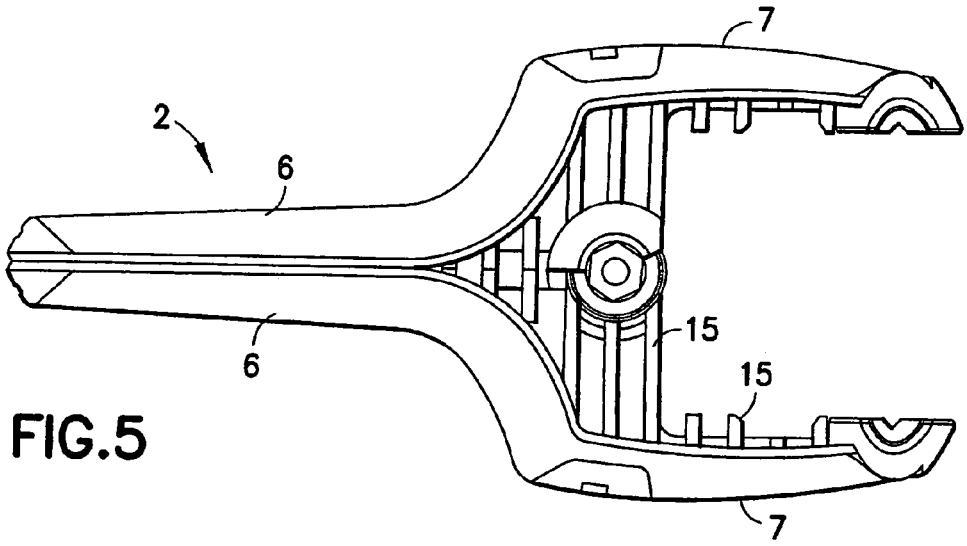
FIG. 5 is a side view of the clamping mechanism in an open position.

Referring now to FIGS. 4 and 5, it is easy to see the alternating and intermeshing nature of strengthening sections 15 arrayed along concave mating surfaces 17. As a result of the present design, despite the increase in strength for lever arms 5, jaw portions 7 and handle portions 6, opposing gripping faces 9, 9, are still parallel at an opened position. Consequently, clamping mechanism 2 can clamp with greater strength and rigidity without an increase in size.

Figure 6:
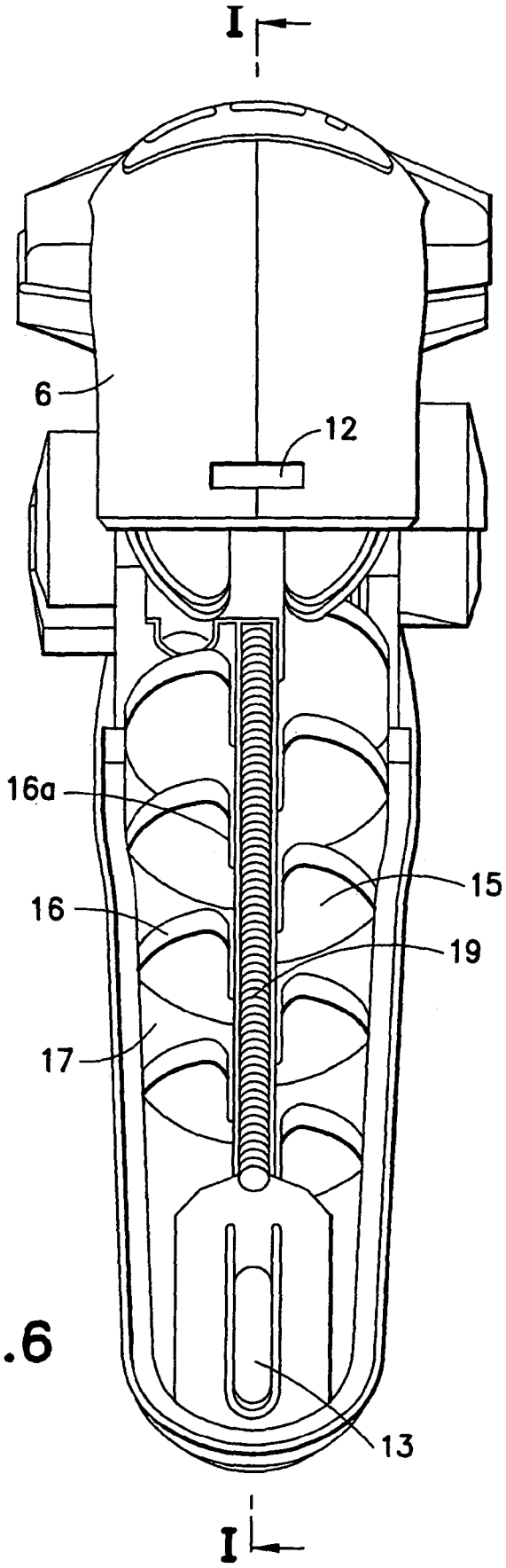
FIG. 6 is a rear view of the clamping mechanism.

Referring now to FIG. 6, spring 19 is a torsion spring member having arms extending along mating surfaces 17 of respective handle portions 6. The arms of spring 19 nest between alternating inner portions 16*a* and are retained there between during use. In this manner, the present design allows easy and speedy assembly while maintaining low manufacturing cost and improving retention of spring 19 in heavy use.

Figure 7:
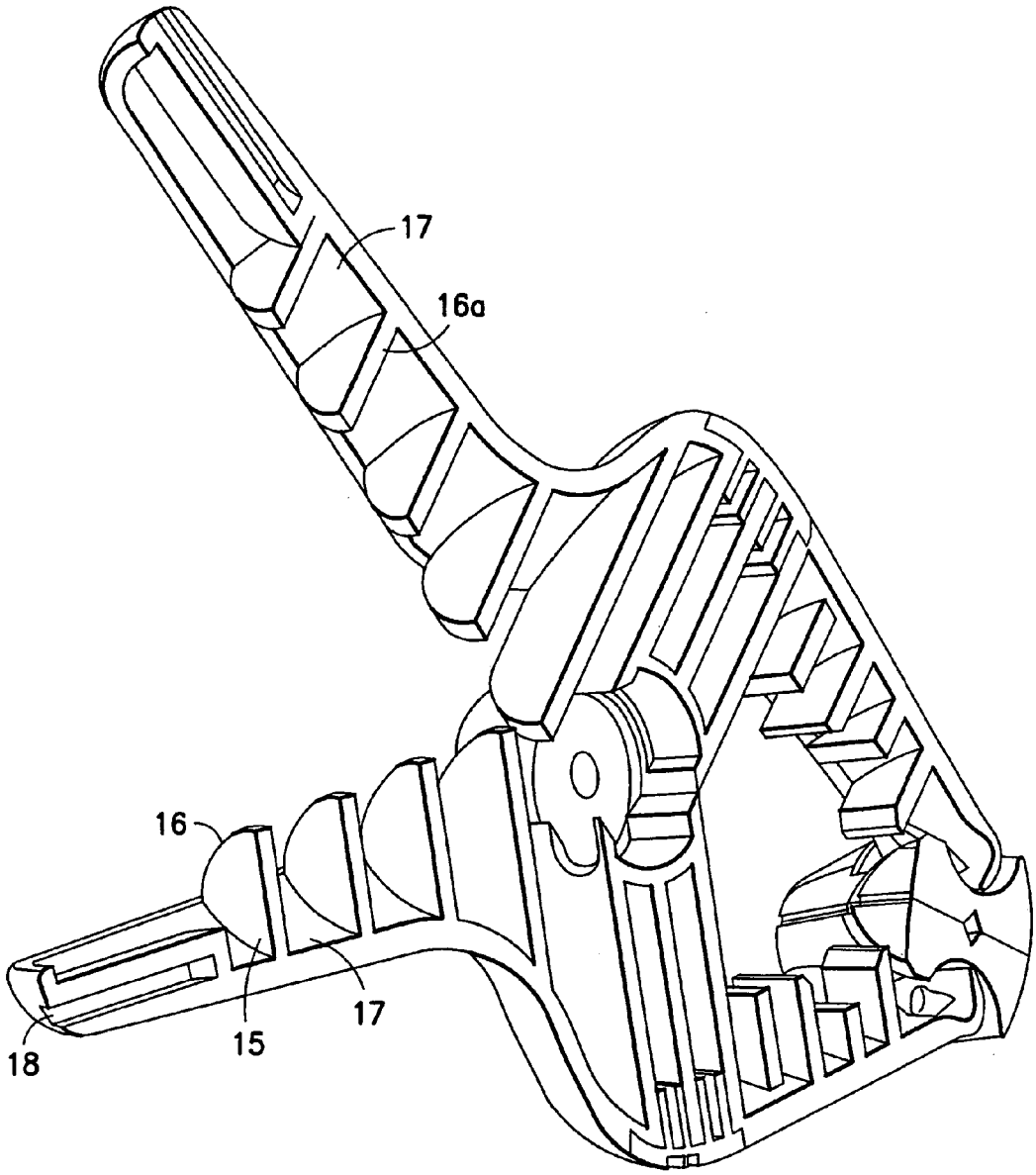
FIG. 7 is a perspective sectional view along line I-I of FIG. 6.

Referring now to FIG. 7, strengthening sections 15 are shown bracing hinge members 11, 11 and allowing the transmission of substantial torsional force through lever arms 5,5 to jaw portions 7, 7 and handle portions 6. A locking slot 18 extends inward from respective clip openings 12 on each handle portion 6 and receives the attachment clip as will be explained.

Figure 8:
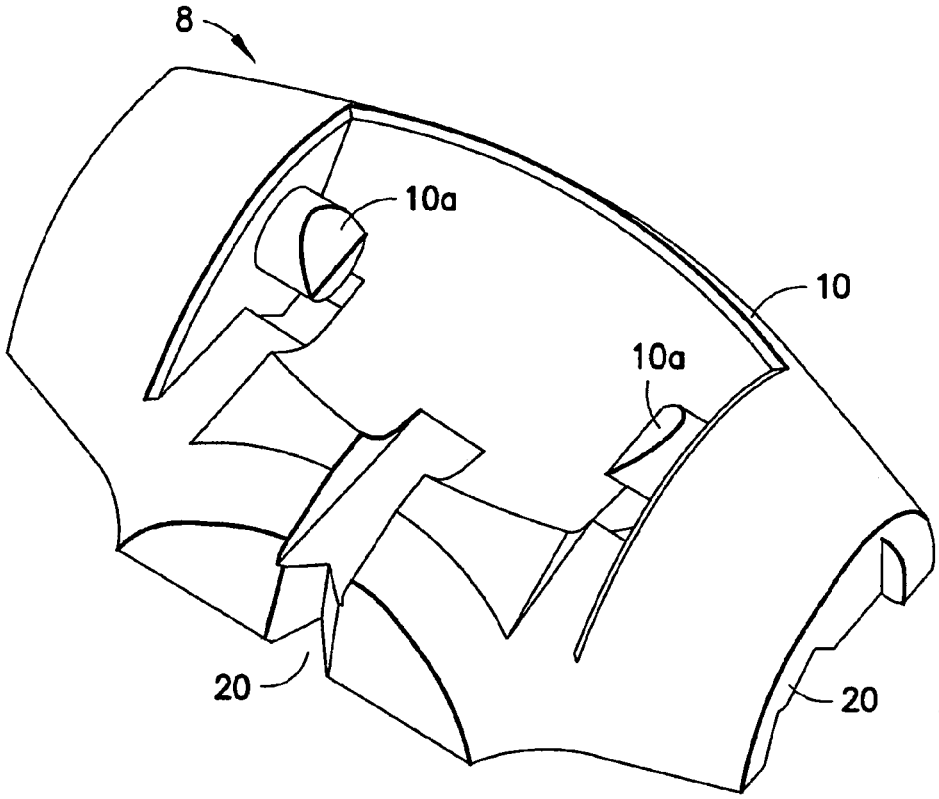
FIG. 8 is a top perspective view of a swivel tip, according to one embodiment of the present invention.
Figure 9:
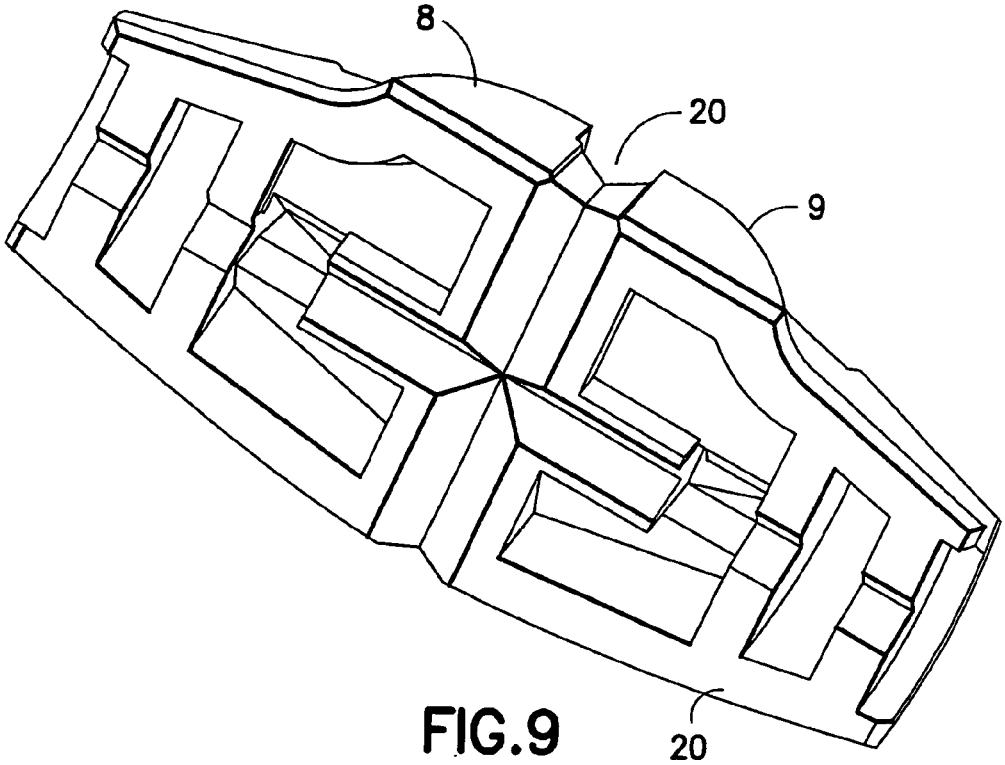
FIG. 9 is a bottom perspective view of a swivel tip, according to one embodiment of the present invention.

Referring now to FIGS. 8 and 9, grooves 20 extend longitudinally and laterally along gripping face 9. Joining face 10 includes a concave portion allowing joining pins 10*a* to swivel around joining holes 10*b*. In this manner, swivel tips 8 of swivel tip mechanism 4 pivot easily relative to a workpiece clamping plane.

Figure 10:
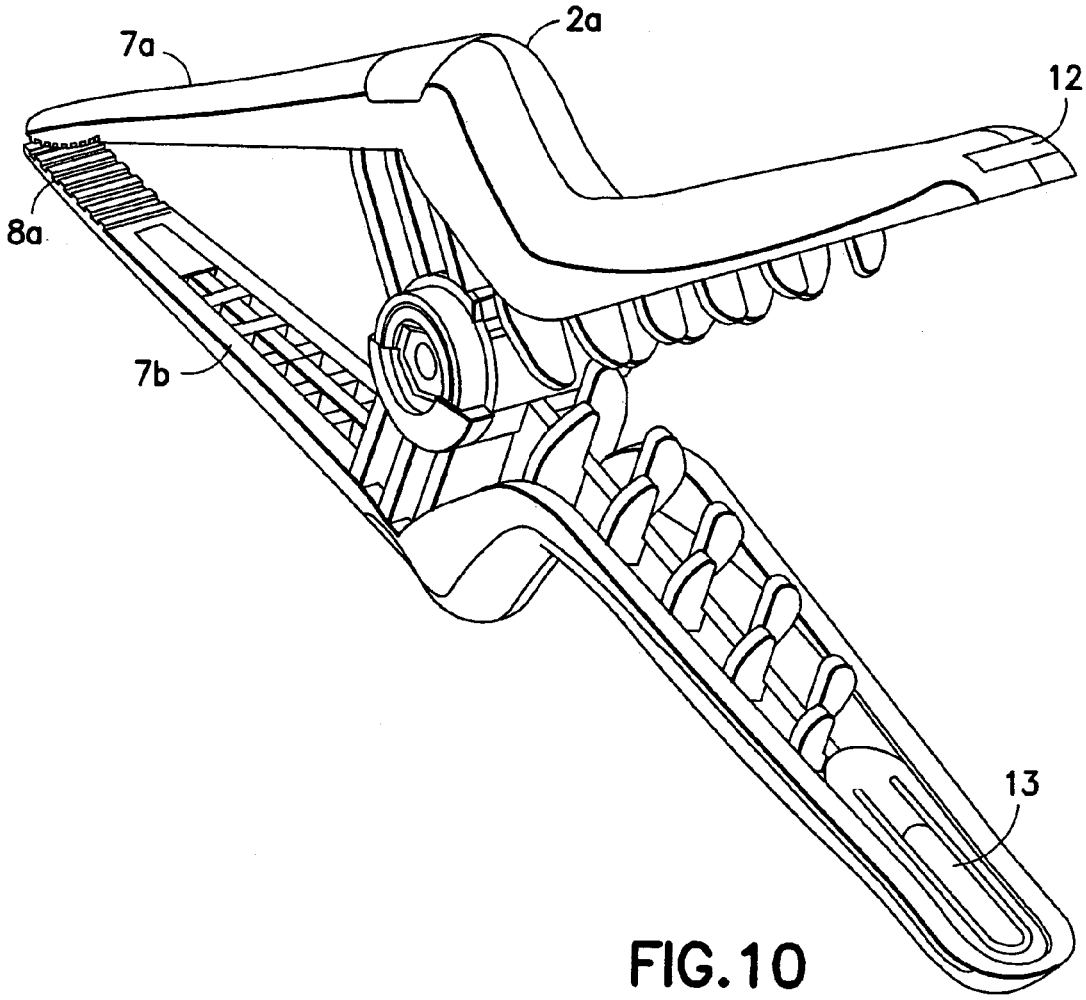
FIG. 10 is a perspective view of another embodiment of a clamping mechanism.
Figure 11:
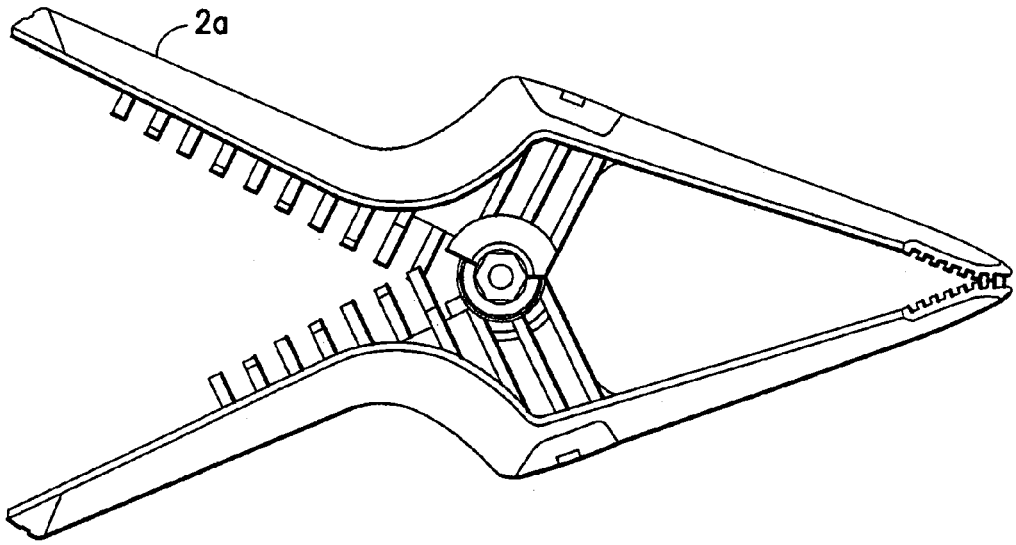
FIG. 11 is a side view of another embodiment of a clamping mechanism in a closed position.
Figure 12:
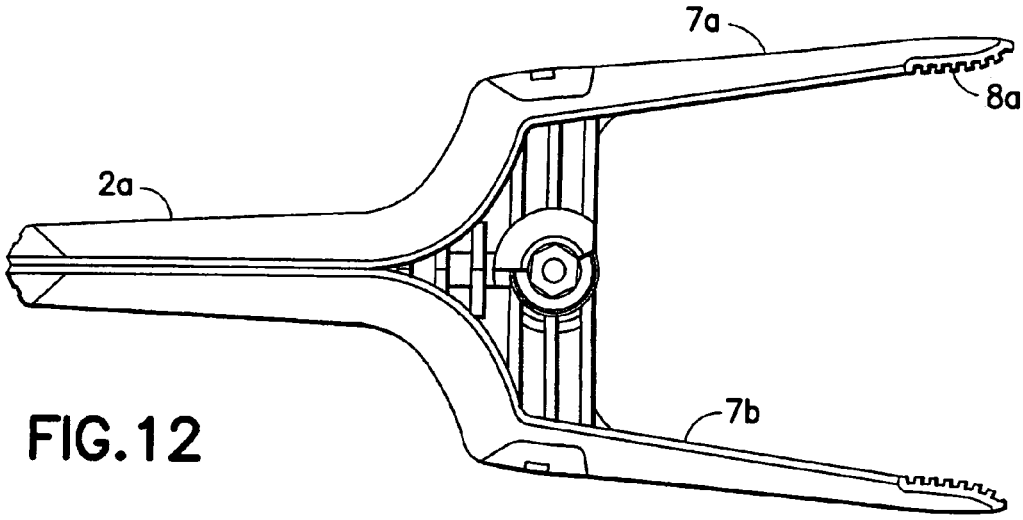
FIG. 12 is a side view of another embodiment of a clamping mechanism in an open position.

Referring now to FIGS. 10, 11, and 12, an alternative embodiment of clamping mechanism 2 is shown as a needle-nose clamping mechanism 2*a*. Needle-nose clamping mechanism 2*a* includes a pair of needle-nose jaw portions 7*a* with planer inner surfaces 7*b* and planar strengthening sections 15. A gripping tip 8*a* extends from each respective needle-nose jaw portion 7*a* and enables clamping fine and small-sized workpieces. Gripping tips 8*a* may be made from any suitable non-marring material, for example an elastomer having a low elastic flow value.

Needle-nose clamping mechanism 2*a* incorporates substantially the elements of the present invention noted above, and in an opened position, places gripping tips 8*a*, 8*a* on workpiece gripping planes exceeding parallel. Consequently, a gripping capacity of clamping mechanism 2*a* is larger than a gripping capacity of similarly dimensioned clamping mechanism 2.

Figure 13:
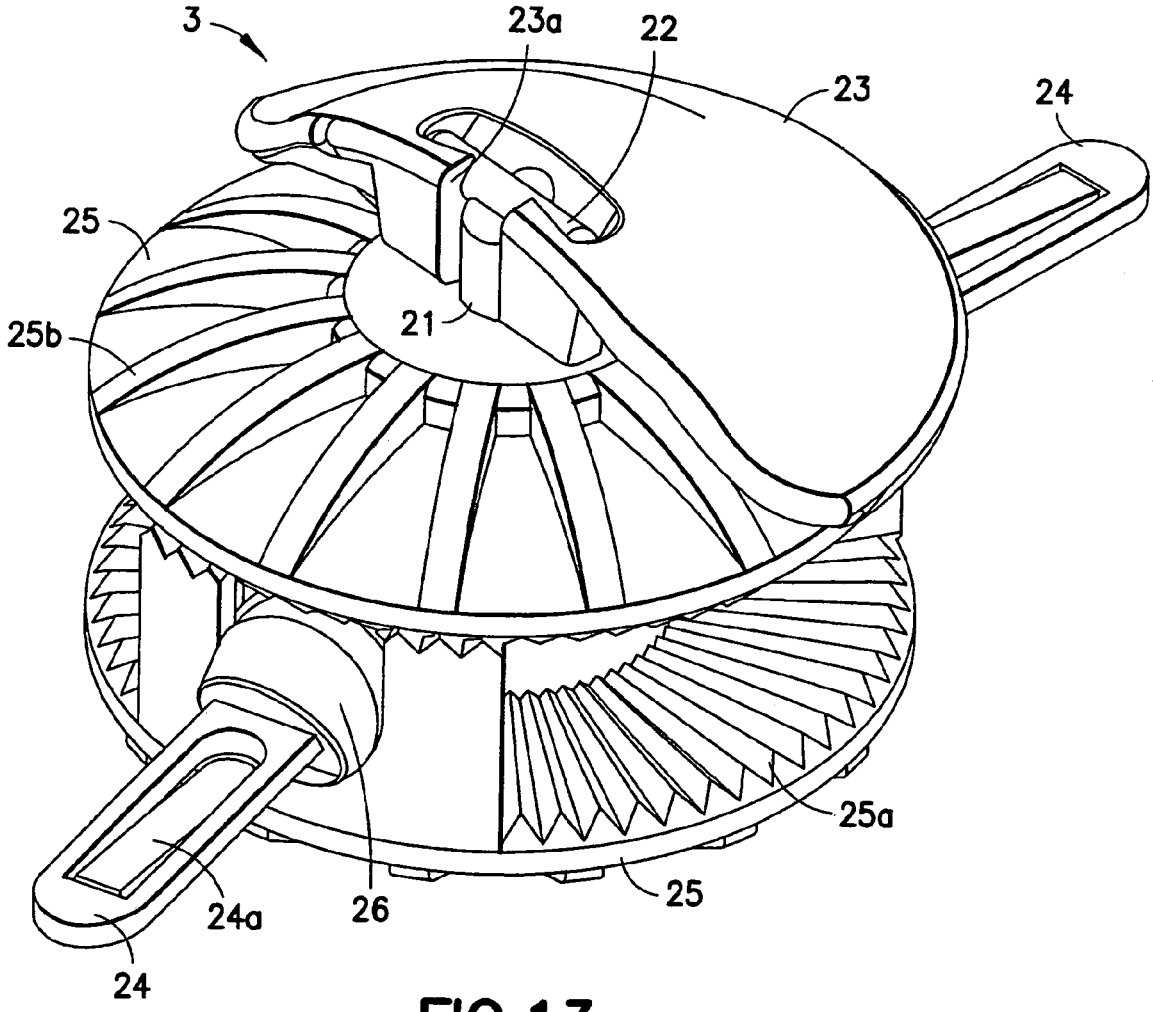
FIG. 13 is a perspective view of a gimbal mechanism, according to one embodiment of the present invention.
Figure 14:
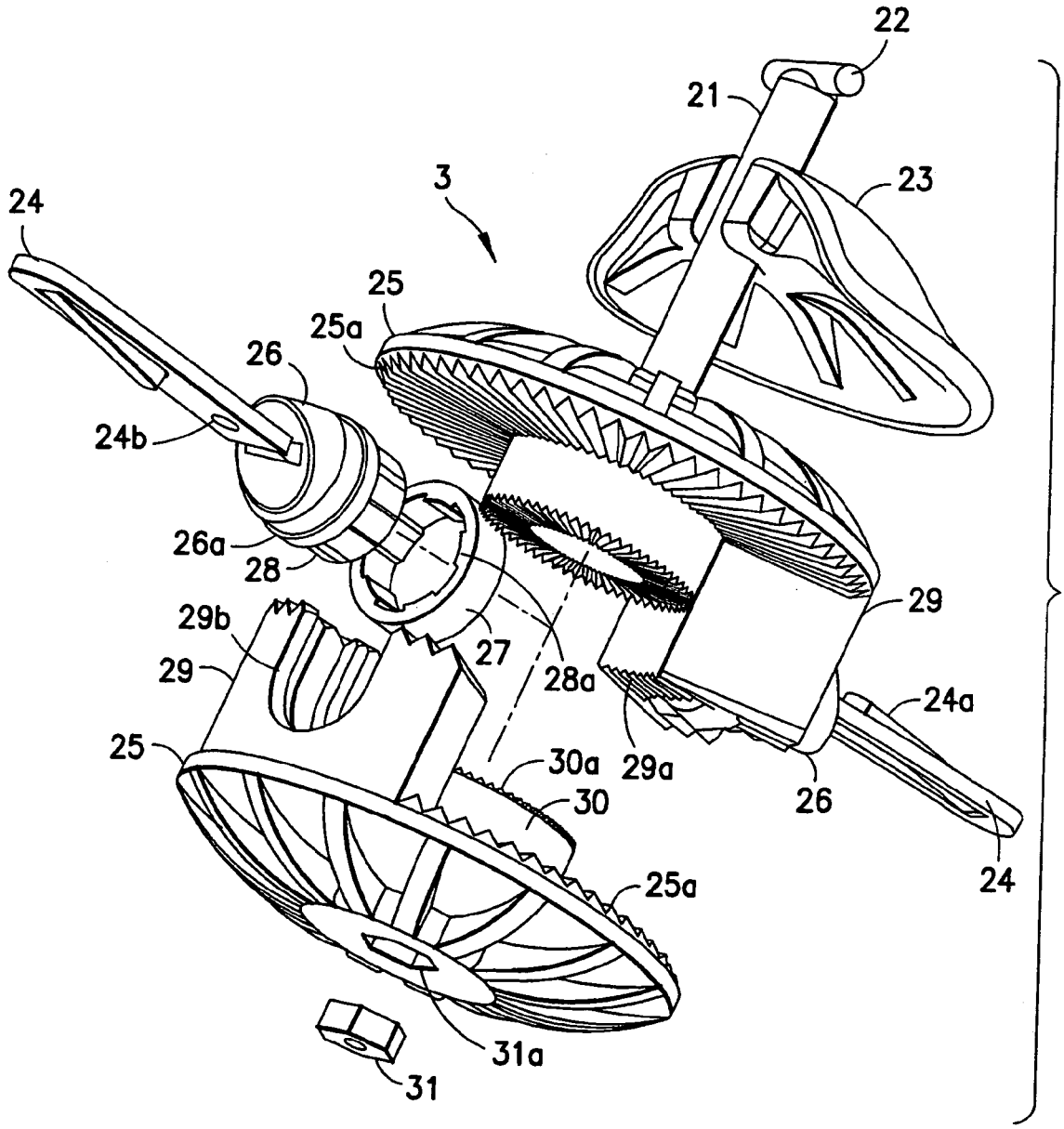
FIG. 14 is an exploded view of the gimbal mechanism.

Referring now to FIGS. 13 and 14, gimbal mechanism 3 includes a T-bolt member 21 extending through and joining an upper and a lower gimbal housing 25, 25. A plurality of ribs 25*b* project radially along an outer circumference of each gimbal housing 25, as shown. A plurality of locking teeth 25*a* project radially along an inner circumference of each gimbal housing 25.

A set of opposing bolt wings 22, 22 project from a top end of T-bolt 21. A locking nut 31 is adjustably affixable to a bottom end of T-bolt 21. A cavity 31*a* in the bottom gimbal housing 25 rotationally fixes locking nut 31 opposite locking lever 23.

A slot 23*a* in a locking lever 23, has an irregular double U-shape, and receives both an upper end of T-bolt 21 and opposing bolt wings 22, 22 as shown. Slot 23*a* allows locking lever 23 to swivel radially relative to each gimbal housing 25 while retaining bolt wings 22 and sliding around a shaft of T-bolt 21 during use. During adjustment, locking lever 23 is pivoted around bolt wings 22, away from the face of gimbal housing 25, and allows rotational adjustment between upper and lower gimbal housings 25, 25, as will be explained. After adjustment, locking lever 23 is pressed against ribs 25*b* and locks upper and lower gimbal housings 25, 25 together.

A spindle housing 29 projects from an outer portion of each gimbal housing 25 as shown. A plurality of teeth 29*a* extend from a top of spindle housing 29 and, in use, intermesh with corresponding teeth 25*a* on the opposite gimbal housing 25, forming a positive-keyed interlock resistive to unintended pivoting.

A rotation spindle 26 is rotatably retained in a U-shaped spindle section 29*b* of spindle housing 29. Attachment clip 24 is fixably retained in an outer end of rotation spindle 26, as will be explained. A spring 24*a* is formed on an outer end of attachment clip 24 on the gimbal mechanism 3 and releasably snap-fixes into clip-lock release 13 on a desired handle portion 6 of the clamping mechanism 2, as shown in FIGS. 19A-19E. As illustrated, FIG. 19D is a sectional view along line III-III of FIG. 19C. A hole 24*b* formed in an inner end of attachment clip 24 fixably retains attachment clip 24 in rotation spindle 26 by engaging a projection (not shown) during an assembly.

A spindle ring 26*a* projects radially around a center portion of rotation spindle 26 as shown. A plurality of keys 28 project outward about an inner bottom end radius of rotation spindle 26 opposite the top end and attachment clip 24.

In the present embodiment, a grommet 27 is an elastic member and elastically surrounds the bottom end of rotation spindle 26. A plurality of groves 28*a* project inward along the inside surface of grommet 27 and during an assembly intermesh with corresponding keys 28 on rotation spindle 26. Grommet 27 is formed from any suitable material, and in one preferred embodiment, is a durable elastomeric material capable of forming a tight elastic fit around keys 28 while receiving a compressive force from teeth 25*a*. Alternative embodiment will be described later wherein grommet 27 is a rigid member including teeth or other engaging members about an outer circumference.

A spacer 30 projects from an inner portion of each opposing gimbal housing 25 adjacent each corresponding spindle housing 29. Each spacer 30 is approximately half the height of the corresponding spindle housing 29. A plurality of teeth 30*a* project from a top surface of each spacer 30 and intermesh with a corresponding plurality of teeth 30*a* on the opposite spacer 30, forming a positive-keyed interlock or simply an interlock The type of positive-keyed interlock formed by teeth 25*a*, 29*a*, and 30*a* is superior to a friction or a tension-type connections which can be shifted with increased force application alone. Since teeth 25*a*, 29*a*, and 30*a* are intermeshed in a positive-keyed interlock, to shift positions a tremendous amount of force is required to first separate, not a single tooth but all the interactive teeth, and second rotate gimbal housings 25, 25. Consequently, the force required to move the present positive-keyed interlock system has a much steeper and requires a longer stress curve before failure than simple friction or tension-type locks.

Figure 15:
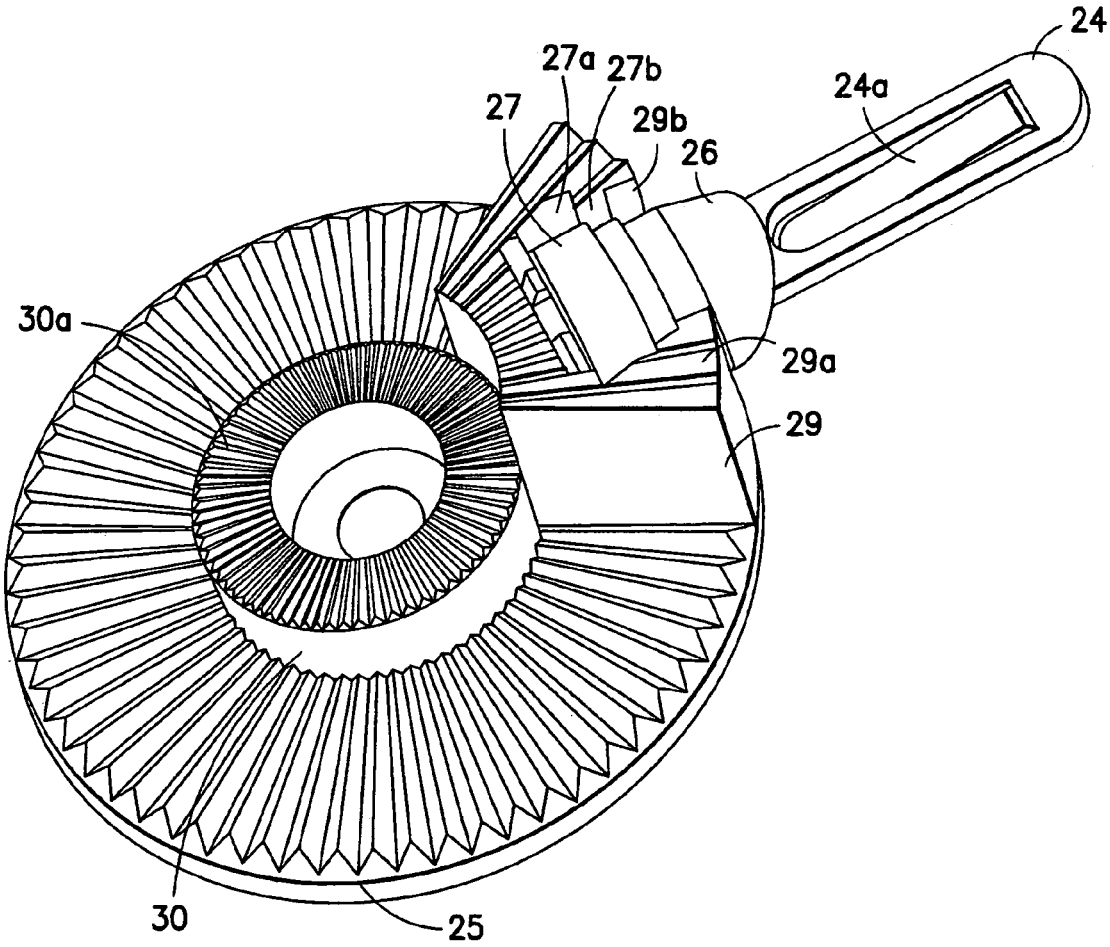
FIG. 15 is a partial perspective view of a gimbal housing.

Referring now to FIG. 15, a U-shaped grommet groove 27*a*, in U-shaped spindle section 29*b* of spindle housing 29, guidably retains grommet 27 during use and rotation. A U-shaped spindle ring groove 27*b*, adjacent grommet groove 27*a*, guidably retains spindle ring 26*a* of rotation spindle 26. Together, spindle ring groove 27*b* and grommet groove 27*a* provide rotational support and prevent an escape of rotation spindle 26 from spindle housing 29 during use.

After assembly, grommet 27 is sized to extend slightly above a bottom of teeth 29*a* on respective spindle housings 29. Consequently, as teeth 29*a* engage respective teeth 25*a*, portions of teeth 25*a* engage, compress, and positionably fix an outer surface of grommet 27. This compression and fixing urges grooves 28*a* onto keys 28 and locks rotation spindle 26 relative to spindle housing 29. In addition to locking rotation, when teeth 25*a* engage grommet 27, rotation spindle 26 is pressed into respective grooves 29*b*, 27*a*, and 27*b*, further securing rotation spindle 26 in gimbal mechanism 3. As an additional benefit of the present invention, as grommet 27 elastically engages teeth 25*a*, spindle 26 is infinitely adjustable during rotation.

In another alternative embodiment, not shown, and as mentioned above, grommet 27 may be selected from a substantially rigid material. In this embodiment, inner grooves 28*a* of grommet 27 still key into keys 28. It should be additionally understood in this embodiment, that at least a portion of the outer surface of rigid grommet 27 includes teeth (not shown) engagable with respective teeth 25*a*. In this manner, toothed grommet 27 enables a keyed and tooth engagement with respective housings 25. It is also envisioned in another alternative embodiment, that grommet 27 may remain formed from an elastomeric material with teeth (not shown) formed on an outer surface. In this manner, the benefits of both an elastomeric material and a keyed and toothed engagement are realized.

In another alternative embodiment of the present invention, teeth are arrayed about an outer diameter of grommet 27 and grommet 27 is made from either an elastomeric or substantially rigid material. In this embodiment, a portion of grommet groove 27*a* also includes engaging teeth (not shown) engageable with the teeth on the outer circumference of grommet 27. Consequently, in this embodiment, the teeth formed on the outer circumference of grommet 27 can engage teeth 25*a* and the teeth in grommet groove 27*a* while simultaneously engaging teeth 25*a*. In this manner, multiple types of keyed and toothed interlocks between gimbal housings 25, 25 are possible with teeth 25*a*, 29*a*, the teeth in grommet groove 27*a* and the teeth on the outer circumference of grommet 27.

In another alternative embodiment (not shown) to the present invention, rotation spindle 26 and spindle housing 29 may be adapted to a semi-spherical construction while still retaining attachment clip 24. This alternative embodiment of grommet 27 is adapted to elastically surround the semi-spherical alternative rotation spindle 27 and lock in place when pressed by teeth 29*a*. In this manner, attachment clip 24 may be moved in three planes relative to gimbal housing 25 while retaining the positive-interlock features of the present invention.

Figure 16:
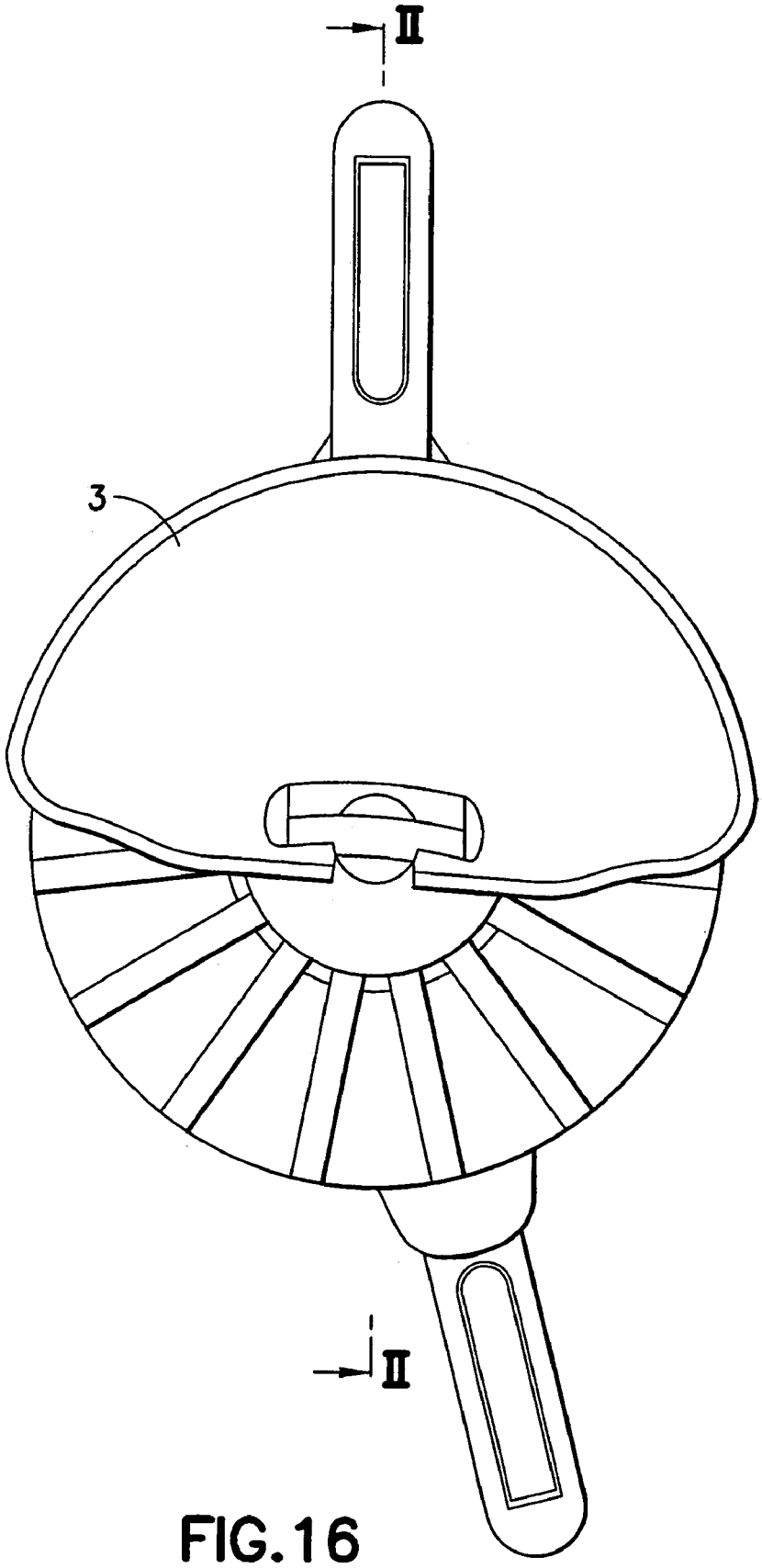
FIG. 16 is a top view of a gimbal mechanism in a locked position.
Figure 17:
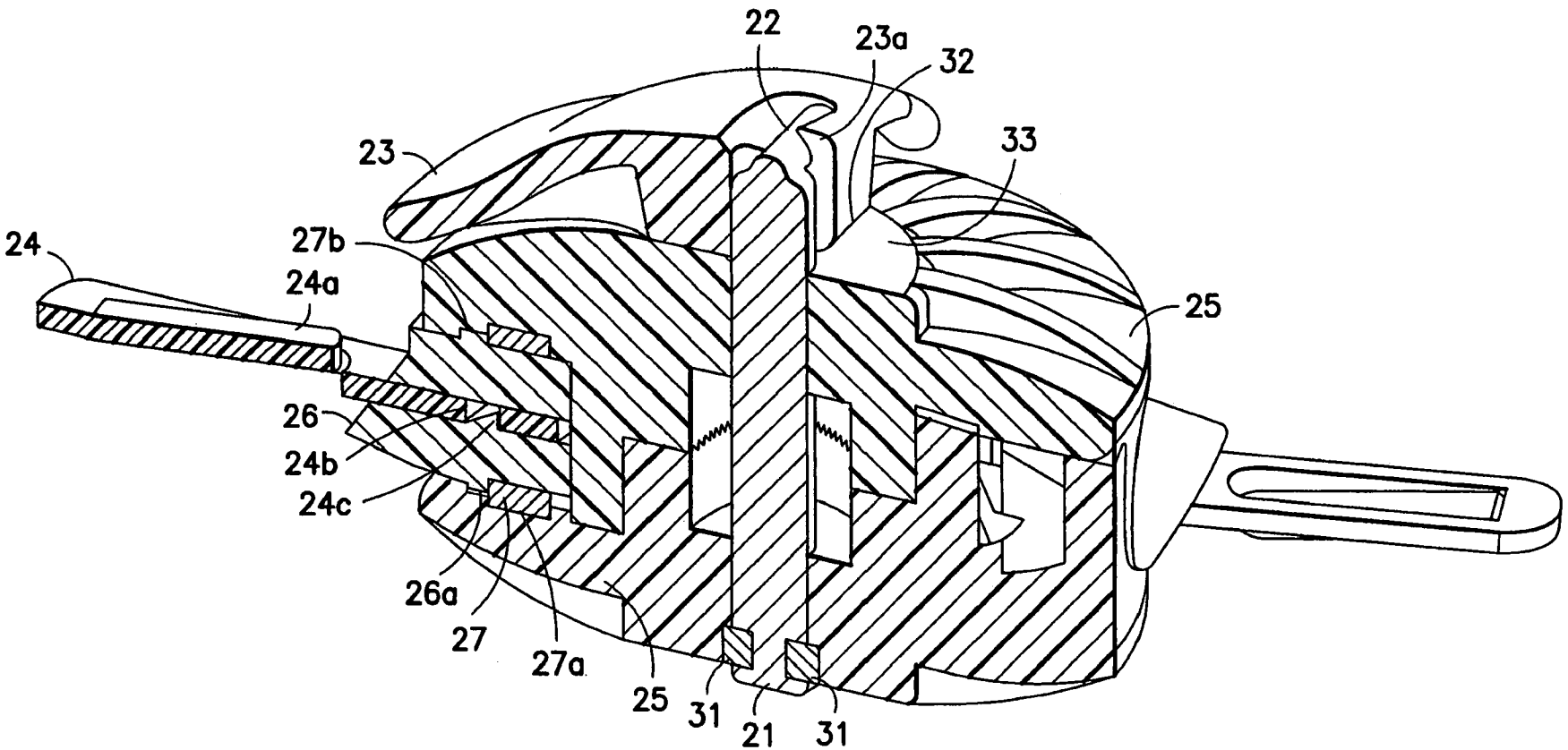
FIG. 17 is a perspective sectional view along line II-II of FIG. 16.

Referring now to FIGS. 16 and 17, a lip 24*c* projects from an inner portion of rotation spindle 26 and positively engages a defining edge of hole 24*b* in attachment clip 24. A flat surface 33 surrounds T-bolt 21 in a center section of each gimbal housing 25, as shown. Locking lever 23 has a flat face (shown but not numbered) adjacent T-bolt 21, bolt wings 22, 22, and slot 23*a*. In a locked position (as shown) a bottom contour of locking lever 23 substantially matches the corresponding surface contour of each gimbal housing 25, and T-bolt 21 is in tension pressing gimbal housings 25, 25 into close alignment.

Adjacent slot 23*a*, an edge of the flat face of locking lever 23, parallel to bolt wings 22, is rounded over forming a camming surface 32. During an operation of locking lever 23, as locking lever 23 rotates about bolt wings 22, camming surface 32 rolls along flat surface 33. When locking lever 23 is in an upright position, the flat face of locking lever 23 contacts flat surface 33, and releases tension on T-bolt 21 allowing relative adjustment of rotation spindles 26, 26 and gimbal housings 25, 25.

Figure 18:
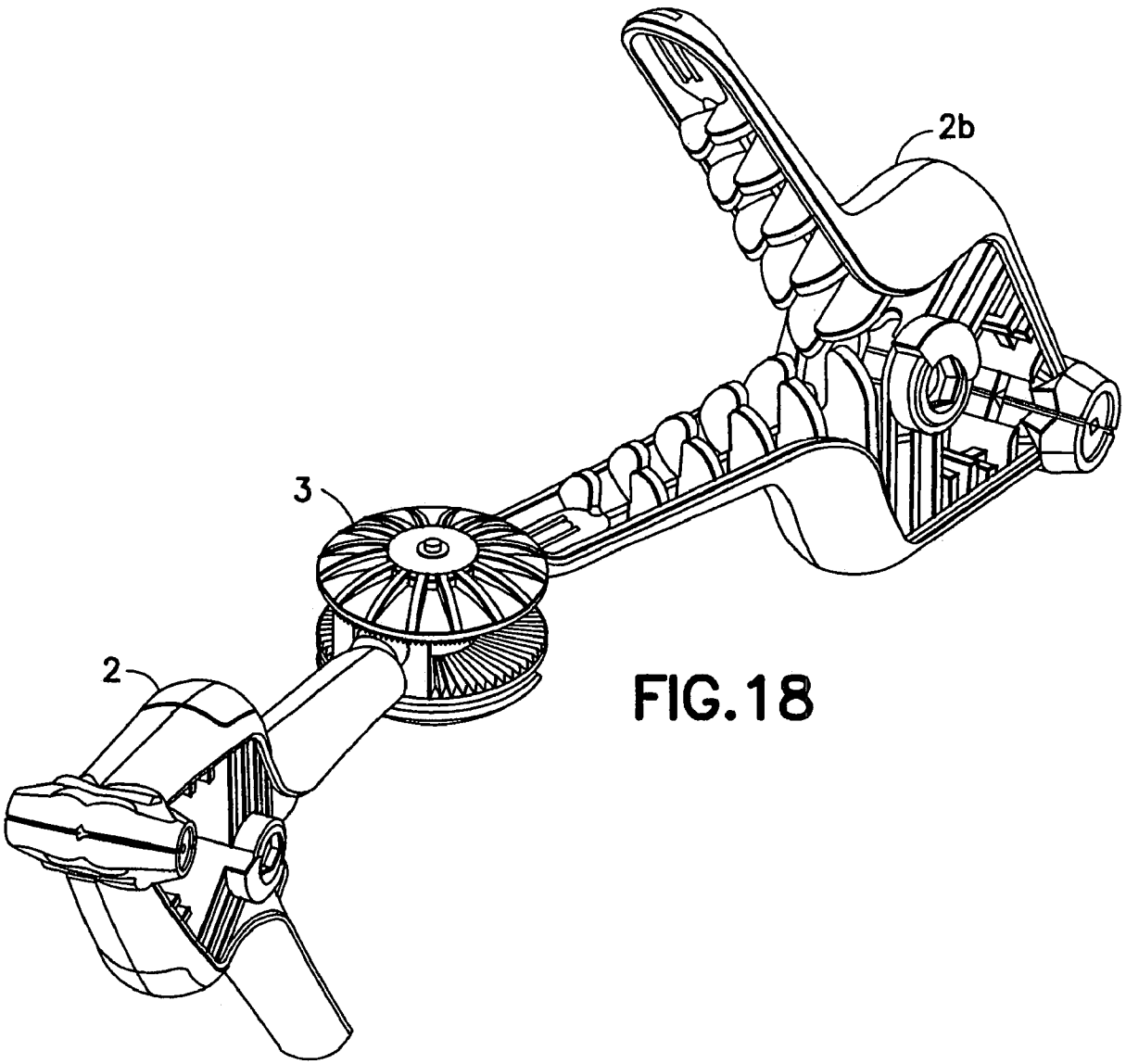
FIG. 18 is perspective view of an alternative embodiment of the present invention.

Referring now to FIG. 18, an alternative embodiment of the present invention includes a larger clamping mechanism 2*b* in use with clamping system 2. Larger clamping mechanism 2*b* has the same structure as clamping system 2 in a larger form useful in clamping larger workpieces. Larger clamping mechanism 2*b* may also be paired with needle-nosed clamping system 2*a*. Consequently, the present invention envisions multiple clamping uses for multi-sized workpieces while maintaining the convenience, adjustability, and rigid lockability of the embodiments shown.

During an assembly of spring clamp system 1, attachment clip 24 is first inserted into rotation spindle 26 until lip 24*c* positively engages hole 24*b*. Grommet 27 is then rotated until grooves 28*a* align with keys 28 on rotation spindle 26 and is pressed on until engaging spindle ring 26*a*. Rotation spindle 26 is positioned in spindle section 29*b* of spindle housing 29. Spindle ring 26*a* slips into spindle ring groove 27*b* and grommet 27 slips into grommet groove 27*a*, preventing rotation spindle 26 from slipping out of spindle housing 29.

Upper and lower gimbal housings 25 are then positioned so that teeth 25*a* mesh with and positively engage teeth 29*a* on the tops of respective spindle housings 29. Simultaneously, teeth 30*a* on respective spacers 30, 30 positively engage and interlock. In this manner, the present invention provides locking engagement between respective gimbal housings 25, 25 around both an inner and an outer radius, relative to T-bolt 21, resulting in a very strong tooth-on-tooth positive locking engagement in gimbal mechanism 3 which prevents rotational slipping. Consequently, gimbal mechanism 3 is able to rigidly maintain the respective positions of attachment clips 24, 24 despite great workpiece weight or movement.

After upper and lower gimbal housings 25, 25 are assembled, T-bolt 21 with bolt wings 22 is positioned in slot 23*a* of locking lever 23 and inserted through the center of gimbal housings 25, 25. While locking lever is in an upright position, locking nut 31 engages the opposite end of T-bolt 21 and is secured in cavity 31*a* thereby preventing locking nut 31 from rotating relative to gimbal housings 25, 25.

During later adjustment, as tension is released on T-bolt 21, teeth 25*a* disengage grommet 27 and allow rotation spindle 26 to rotate as desired until tension is reapplied.

During operation, in a locked position, tension along T-bolt 21 urges gimbal housings 25, 25 tightly together, and positively engages respective teeth 25*a*, 29*a*, and 30*a*. Additionally, teeth 25*a* engage grommet 27 and press grommet 27, including grooves 28*a*, against rotation spindle 26 and keys 28 preventing rotation relative to gimbal mechanism 3.

Assembling clamping mechanism 2 involves matching opposing lever arms 7, 7 and inserting arms of spring 19 along inner portions 16*a* while aligning hinge members 11. A retaining pin or bolt (not shown) is then inserted axially through the center hole of hinge members 11 locking lever arms 7, 7 together.

Assembling spring clamp system 1 requires inserting attachment clip 24 and spring 24*a* through a selected clip opening 12 into locking slot 18. In this manner, spring 24*a* release-ably snaps into locking slot 18 and secures clamping mechanism 2 to gimbal mechanism 3.

One advantage of the present invention is that strengthening sections 15 allow a slimmer handle portion 6 profile while maintaining, even increasing a grip-capacity for clamping mechanisms 2, 2*a*, and 2*b*.

Another advantage of the present invention is that strengthening sections 15 rigidify handle portions 6 and hinge members 11, 11 and aid in resisting lateral and rotational torsion created by the human hand.

Another advantage of the present invention is that concave curved portions 16, on strengthening sections 15, automatically correct any misalignment caused by lateral or rotational torsion by engaging the outer surface of handle portion 6 and providing guiding contact to concave mating surfaces 17. In combination, curve portions 16 of strengthening sections 15 and mating surfaces 17 act as a way of aligning handle portions 6 and resisting misalignment during an operation. Consequently, even if lever arms 5 are misaligned due to lateral or rotational torsion, in a opened position, misalignment is prevented and uniform alignment is secured during opening allowing maximum opening capacity.

Another advantage of the present invention is that standing alone, clamping mechanism 2 provides an improved way to clamp workpieces, and while enabled with the disclosed gimbal mechanism 3, a simple way to lockably align workpieces relative to another workpiece or an external stabilizer such as a shelf, bench, or post.

Another advantage of the present invention is that clip-lock releases 13 on locking slots 18 receive attachment clip 24 with springs 24*a* and provide an easy, speedy, and lockably secure way to attach clamping mechanisms 2 to gimbal mechanism 3. Consequently, it is easy to remove gimbals mechanism 3 for readjustment of either clamping mechanism 2 or gimbals mechanism 3 without releasing a workpiece.

As a further convenience, it is easy to use clamping mechanism 2 as an individual unit without the inconvenience of a fixed attachment pin 24 extending from handle portion 6. Since clamping mechanisms 2 receive frequent rough treatment, it is beneficial to be able to remove the bendable attachment clip 24.

Another advantage of the present invention is that conventional plastic forming methods can provide the present clamping mechanism 2 having an increased strength without increasing thickness. The use of specially formed strengthening sections 15 and display member 14, which allows easy forming of hinge members 11, 11, while providing an improved design of manufacture.

The present invention allows convenient assembly of clamping mechanism 2 and allows arms from spring 19 to extend along inner portions 16*a* while preventing slippage and misalignment of springs 19 despite frequent use or rotational torsional. Since the arms of spring 19 are retained between rigid inner portions 16*a*, the spring arms cannot shift and scrape mating surfaces 17 or interfere with curved portions 16 providing further durability.

Another advantage of the present invention is the easy rotation and lock-repositioning of rotation spindle 26 relative to spindle housing 29 and gimbal mechanism 3. Upon the release of gimbal housings 25, teeth 25*a* disengage grommet 27 and allow spindle 26 and attachment clip 24 to rotate in spindle section 29*b* while being retained by both grommet groove 27*a* and spindle ring groove 27*a*. The easy rotation and lock-repositioning provided by the interaction of rotation spindle 26, spindle housing 29, and gimbal housing 25 functions as a way to easily reposition clamping mechanism 2 through 360° relative to gimbal mechanism 3.

Another advantage of the present invention is the positive-locking ability of gimbal mechanism 3 which results from the intermeshing of respective teeth 25*a*, 29*a*, and 30*a* along both inner and outer portions of gimbal housings 25, 25. The present invention thus provides a great deal more security than some type of simple friction fit or clamp. The camming-locking elements of gimbal mechanism 3, include locking lever 23, bolt wings 22, U-bolt 21, locking nut 31, camming surface 32, flat surface 33 and the flat face of locking lever 23 while providing an easy way to reposition gimbal housings 25 without fumbling with small parts. As a consequence of these elements and rotation spindle 26, gimbal mechanism 3 functions as an improved way to position and lock multiple clamping mechanisms 2 throughout three planes of motion.

It should be understood by those skilled in the art that the use of the phrase attaching means may refer alternatively to a separate attaching member that releaseably attaches the gimbal mechanism to a fixed item, a spring clamp, or a clamping means as otherwise disclosed herein.

In the claims, means- or step-plus-function clauses are intended to cover the structures described or suggested herein as performing the recited function and not only structural equivalents but also equivalent structures. Thus, for example, although a nail, a screw, and a bolt may not be structural equivalents in that a nail relies on friction between a wooden part and a cylindrical surface, a screw's helical surface positively engages the wooden part, and a bolt's head and nut compress opposite sides of a workpiece part, in the environment of fastening wooden parts, a nail, a screw, and a bolt may be readily understood by those skilled in the art as equivalent structures.

Having described at least one of the preferred embodiments of the present invention with reference to the accompanying drawings, it is to be understood by those skilled in the art that the invention is not limited to those precise embodiments, and that various changes, modifications, and adaptations may be effected therein by one skilled in the art without departing from the novel teachings, scope, advantages, or spirit of the invention as defined in the appended claims.

What is claimed is:

1. A spring clamp system, comprising:

a hand operated clamp;

a positioning base coupled to the clamp and including first and second housings each with a plurality of mating formation interlocks disposed around a pivot axis, wherein the base is operable to a positive-lock position with the interlocks engaged and the clamp fixed relative to the housings and is operable to an adjustment position with the interlocks released from mating contact and the clamp moveable with the second housing about the pivot axis relative to the first housing;

an attachment clip extending from an outer surface of the base;

a spring member on the attachment clip; and an attachment portion of the hand operated clamp defining a clip-opening for receiving the attachment clip, wherein the clip-opening is in communication with a locking slot that selectively retains the spring member.

2. The spring clamp system of claim 1, wherein the clamp couples to the second housing via a lockable rotation spindle.

3. The spring clamp system of claim 1, further comprising an additional clamp coupled to the base and moveable with the first housing about the pivot axis relative to the second housing in the adjustment position of the base.

* * * * *

UNITED STATES PATENT AND TRADEMARK OFFICE

CERTIFICATE OF CORRECTION

PATENT NO. : 7,766,313 B2
APPLICATION NO. : 10/706491
DATED : August 3, 2010
INVENTOR(S) : Panosian It is certified that error appears in the above-identified patent and that said Letters Patent is hereby corrected as shown below:

Title Page in the References Cited (56):

Please insert --Quick-Grip 58300 Spring Clamps printout, Pages 1-3, printed 1/10/03--.

Signed and Sealed this

Twenty-first Day of December, 2010

David J. Kappos

David J. Kappos
*Director of the United States Patent and Trademark Office*